US005242369A

United States Patent [19]

Eschweiler, Jr. et al.

[11] Patent Number: 5,242,369

[45] Date of Patent: Sep. 7, 1993

[54] CROSS FOLDING APPARATUS

[75] Inventors: Earl E. Eschweiler, Jr., Norwalk; Susan Mahmoodi, Southbury, both of Conn.

[73] Assignee: Pitney Bowes Inc., Stamford, Conn.

[21] Appl. No.: 924,997

[22] Filed: Aug. 5, 1992

[51] Int. Cl.[5] ..... B65H 45/14

[52] U.S. Cl. ..... 493/421; 493/420

[58] Field of Search ..... 493/419-421, 493/249

[56] References Cited

U.S. PATENT DOCUMENTS

| | | | |
|---|---|---|---|
| 1,946,142 | 2/1934 | Hitchcock | 493/421 |
| 1,987,352 | 1/1935 | Tufts | 493/420 |
| 3,211,448 | 10/1965 | Stoothoff | 493/421 |
| 3,550,930 | 12/1970 | Brown | 493/421 |

*Primary Examiner*—Bruce M. Kisliuk
*Assistant Examiner*—Jack Lavinder
*Attorney, Agent, or Firm*—Charles R. Malandra, Jr.; Melvin J. Scolnick

[57] ABSTRACT

Apparatus for cross-folding a sheet of paper. The apparatus includes: a first paper folder for imparting a first fold to a paper sheet; an inverting chute located adjacent and downstream of the first paper folder; a transport module located adjacent and downstream of the inverting chute for changing the direction of travel of the once folded paper sheet perpendicular to the direction of travel through the first paper folder; a second paper folder for imparting a second fold to the once folded paper sheet perpendicular to the first fold; and a device for causing the paper sheet to enter or bypass the inverting chute.

2 Claims, 5 Drawing Sheets

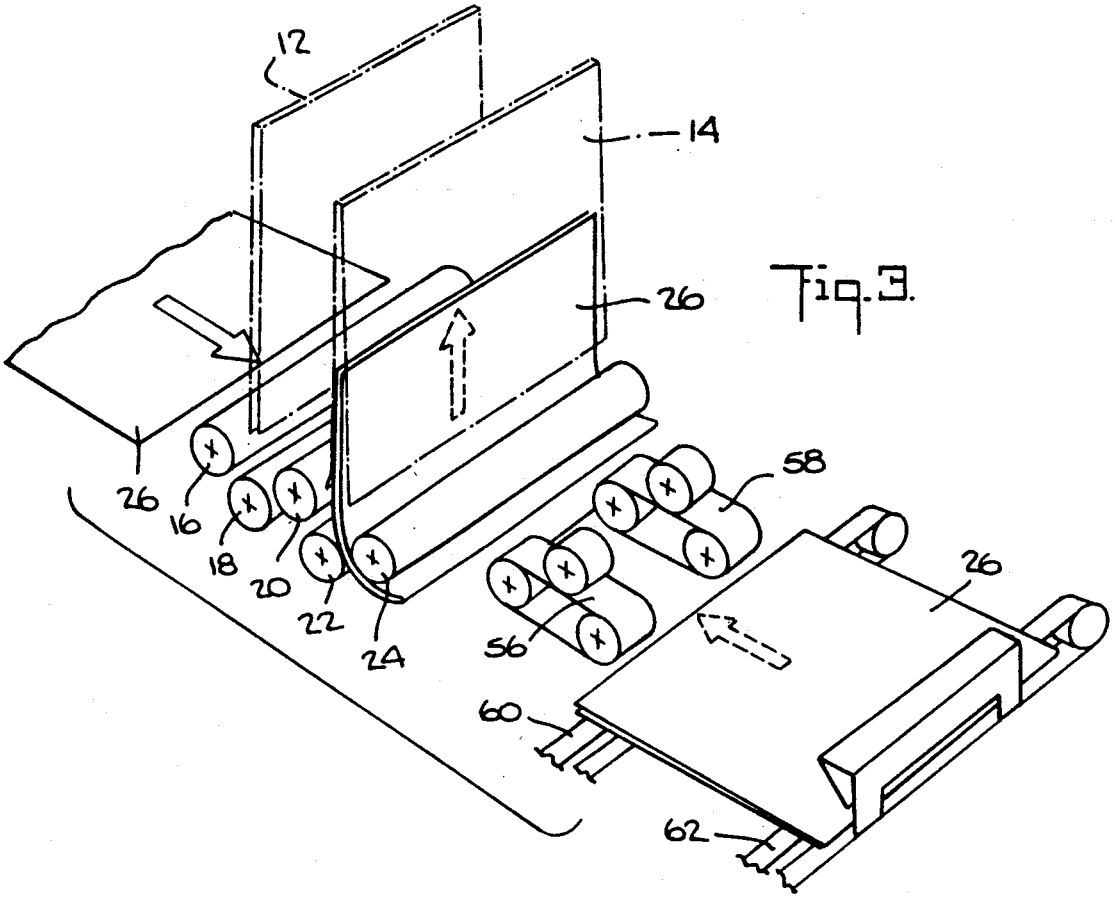
Fig. 3.
Fig. 4.
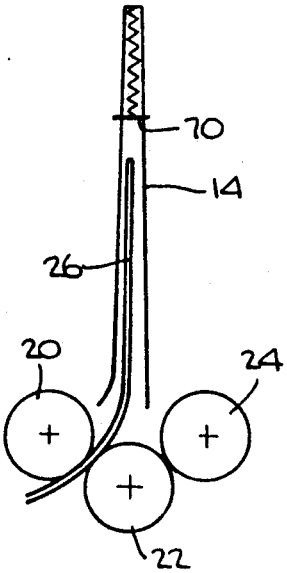
Fig. 5.
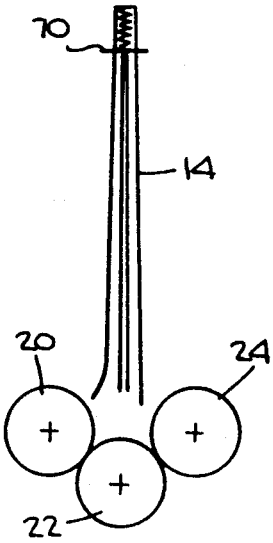
Fig. 6.
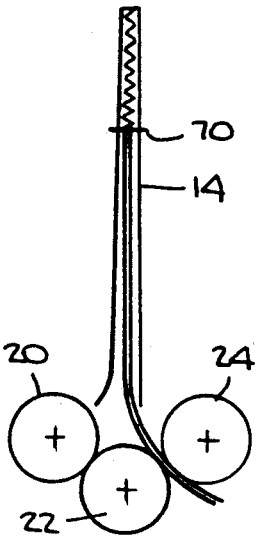

CROSS FOLDING APPARATUS

BACKGROUND OF THE INVENTION

The instant invention relates to paper folding apparatus, and more particularly to apparatus used for imparting perpendicular (cross) folds to paper sheets.

It is well known to fold paper sheets using buckle chute folders to impart one or more folds. In some operations it is desirable to impart two folds perpendicular to each other. Such operations typically employ similar folders oriented perpendicular to each other and change the direction of travel of the document being folded so that after it is folded in one direction, its path of travel is changed to become perpendicular to the original path of travel whereupon the folded document enters a second folder and is folded along a line perpendicular to the original fold line. Such a combination of folding is referred to in the art as cross-folding.

In a cross-folding machine, a single sheet of paper is folded once (partially, or in half) by a folder and the once-folded sheet of paper is then deposited onto the deck of a transport module in order to be moved in a direction perpendicular to the original paper path. The sheet of paper is then folded again (in half, in a Z, or standard fold) by a second folder.

Typically, the paper sheets are fed from a feeder deck with the address face down toward a first buckle chute folder, and the address is positioned near the lead edge of the sheet. After it is folded once, the paper sheet emerges from the first buckle chute folder on the transport deck with the address now face up. Occasionally it happens that the documents include an address that is situated near the trailing edge of the sheet. In such a case, if the paper sheets are fed with the address face down toward a first buckle chute folder, the sheet will emerge from the first buckle chute folder onto the transport deck with the address face down. Since the address needs to be face up for further processing, such an arrangement is unacceptable. Heretofore, the solution to this problem has been to move the feeder deck and the first buckle chute folding module from one side of the transport deck to the other, in order that the paper sheet is deposited on the transport deck with its address facing up. Such moving of the feeder deck and the folding apparatus is undesirable for obvious reasons.

Thus, the instant invention overcomes the problems associated with cross-folding documents having addresses at both the leading and trailing edges of the paper sheet by using an inverting chute in combination with the first buckle chute folder. The use of an inverter obviates the need to move the feeding and folding apparatus from one side of the transport deck to the other.

SUMMARY OF THE INVENTION

Accordingly, the instant invention provides apparatus for cross-folding a sheet of paper. The apparatus includes: a first paper folder for imparting a first fold to a paper sheet; an inverting chute located adjacent and downstream of said first paper folder; a transport module located adjacent and downstream of said inverting chute for changing the direction of travel of said once folded paper sheet perpendicular to the direction of travel through said first paper folder; a second paper folder for imparting a second fold to said once folded paper sheet perpendicular to said first fold; and means for causing said paper sheet to enter or bypass said inverting chute.

BRIEF DESCRIPTION OF THE DRAWINGS

FIG. 3 is a schematic, perspective view of the folder, inverter and transport module seen in FIG. 1 showing the inverting of a paper sheet;

FIG. 4 is a schematic, side view showing the paper sheet inverter;

FIG. 5 is similar to FIG. 4 but shows the length of the paper sheet inside the inverter;

FIG. 6 is similar to FIG. 5 but shows the paper sheet leaving the inverter;

DETAILED DESCRIPTION OF THE PREFERRED EMBODIMENT

Figure 1:
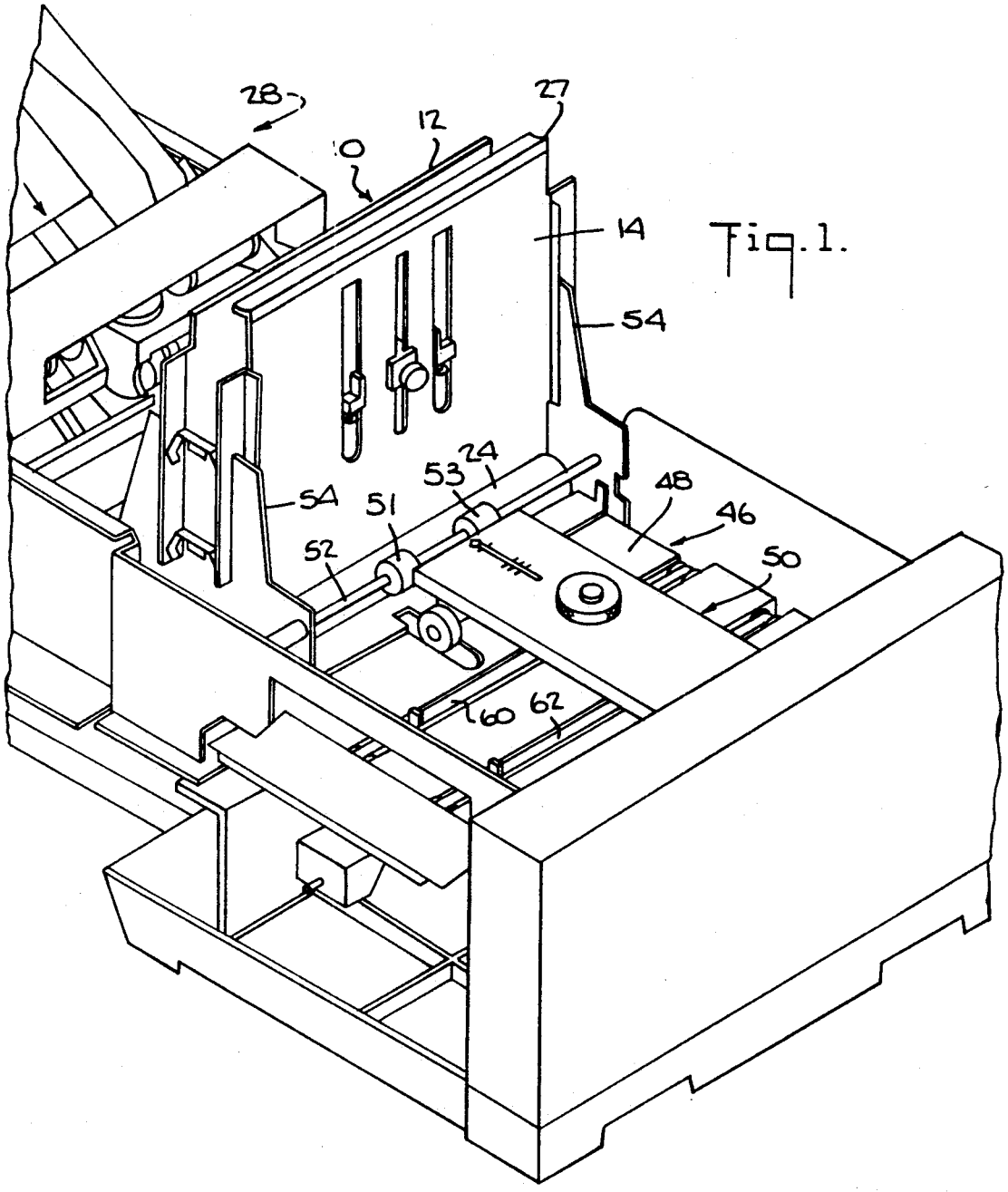
FIG. 1 is a perspective view of a folding module and transport module used-to effect cross folding of paper sheets utilizing in accordance with the instant invention.
Figure 2:
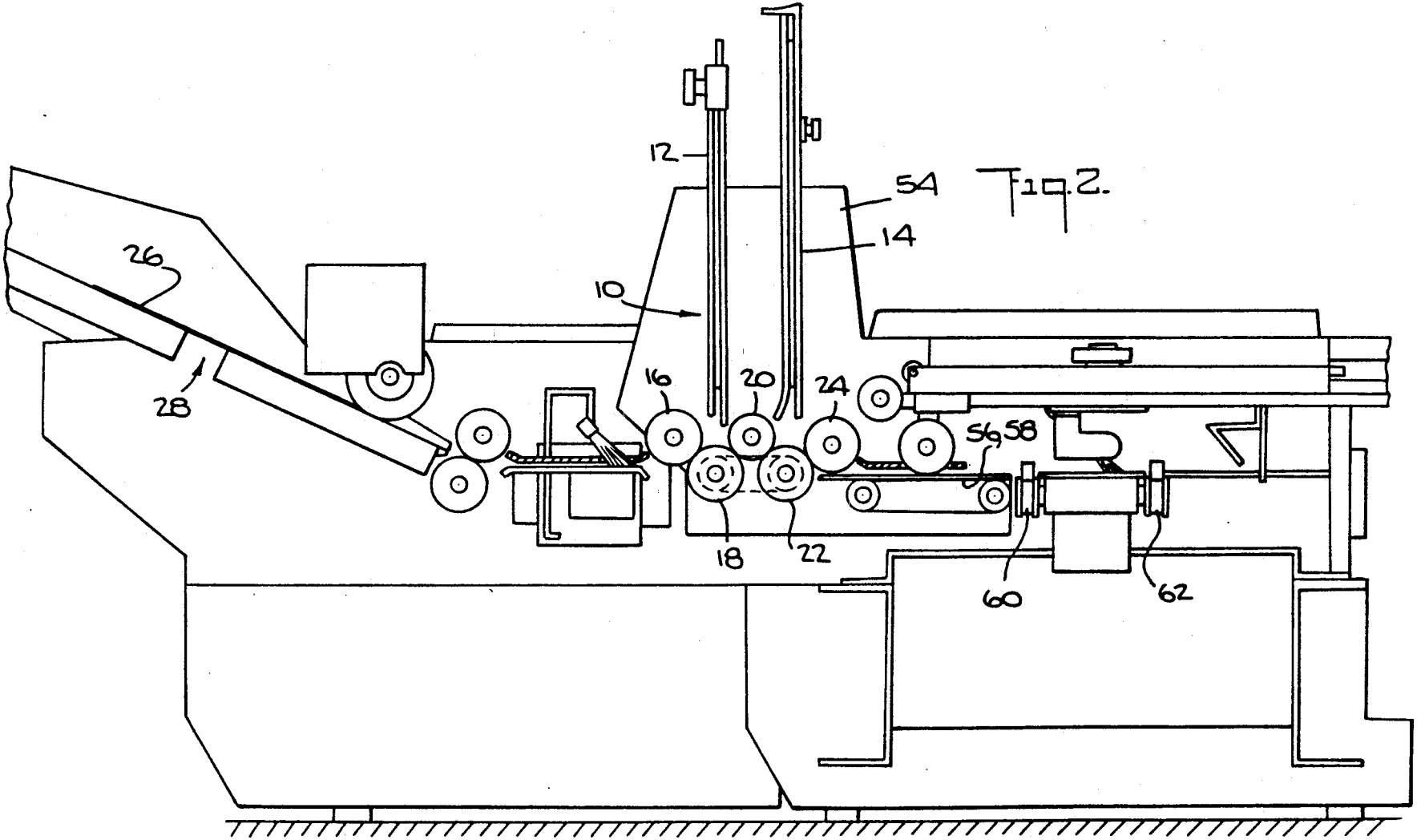
FIG. 2 is a side, elevational view of the apparatus seen in FIG. 1.
Figure 7:
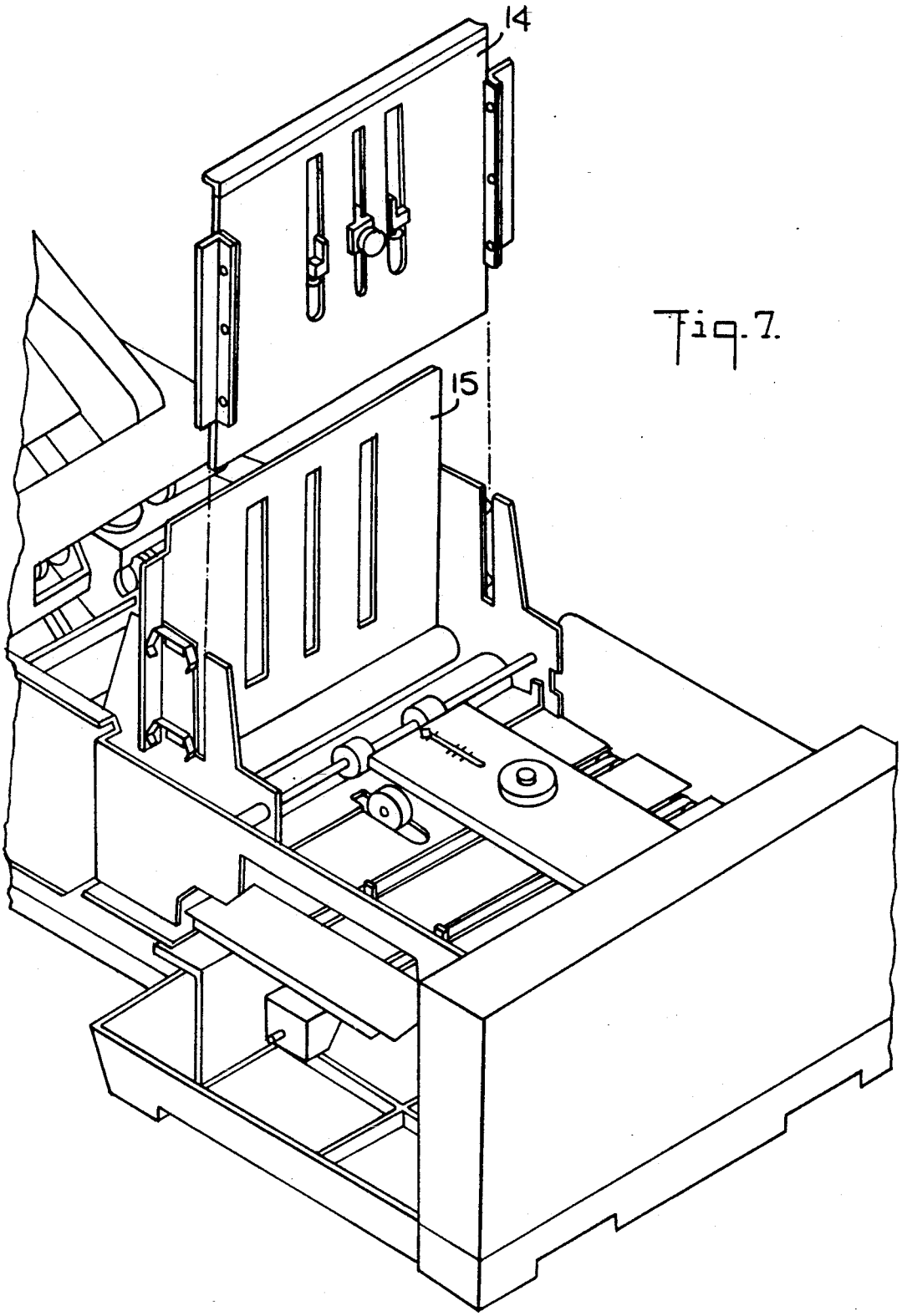
FIG. 7 is similar to FIG. 1 but shows the inverter chute removed from the housing in the course of reversing the chute.
Figure 8:
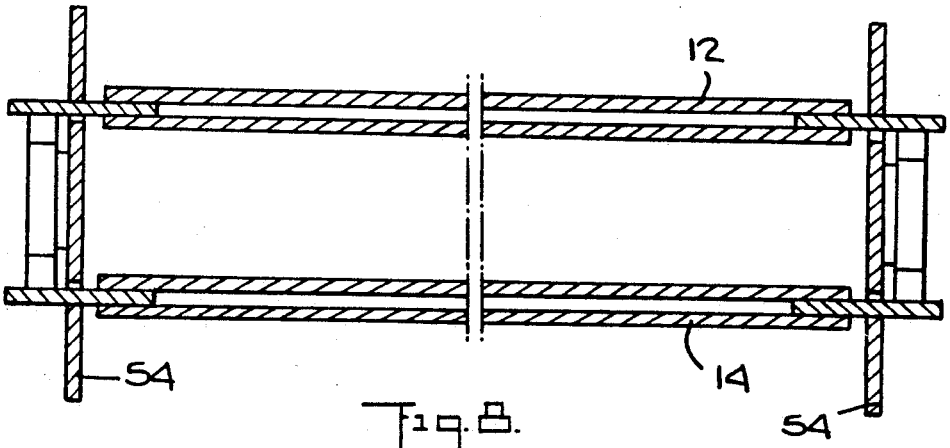
FIG. 8 is a horizontal, sectional view of the inverter chute seen in FIGS. 4–6, showing the fit of the inverter chute in the housing.

In describing the preferred embodiment of the instant invention, reference is made to the drawings wherein there is seen a first buckle chute folder 10 consisting of a chute 12 and feeding/folding rollers 16, 18 and 20. Downstream of the buckle chute 12 is an inverting chute 14 situated on a chute housing 15 and additional feeding/folding rollers 22 and 24. Paper sheets 26 which are to be cross folded are fed from a document feeder 28 to the rollers 16 and 18 to be folded by the buckle chute 12 and the rollers 18 and 20. The fold is created in a line perpendicular to the direction of travel, as is conventionally known, and the fold can be created midway between the ends of the sheet to effect a half fold, or some other line to effect whatever length fold is desired.

After the once folded sheet of paper 26 emerges from the rollers 18 and 20, it may or may not enter the inverting chute 14, which will be discussed in greater detail hereinbelow. After having entered the inverting chute 14 or bypassed the inverting chute 14, the once folded sheet 26 enters a transport module 46 which includes a feed deck 48 and a pivotable paper stop assembly 50 mounted on blocks 51 and 52 which are free to rotate around a shaft 52 which is secured to the side frames 54 of the chutes 12 and 14. The transport module 46 includes a pair of continuously running flat belts 56 and 58 (see FIG. 3) to feed the once folded sheet of paper 26 onto the top of a pair of timing belts 60 and 62 (see FIG. 1) which are perpendicular to the pair of flat belts 56 and 58 which run on demand. The pair of timing belts 60 and 62 then feed the folded sheet 26 toward a second buckle chute folder (not shown) downstream of the transport module 46 in a direction perpendicular to the direction from which the folded sheet 26 arrived.

Figure 9:
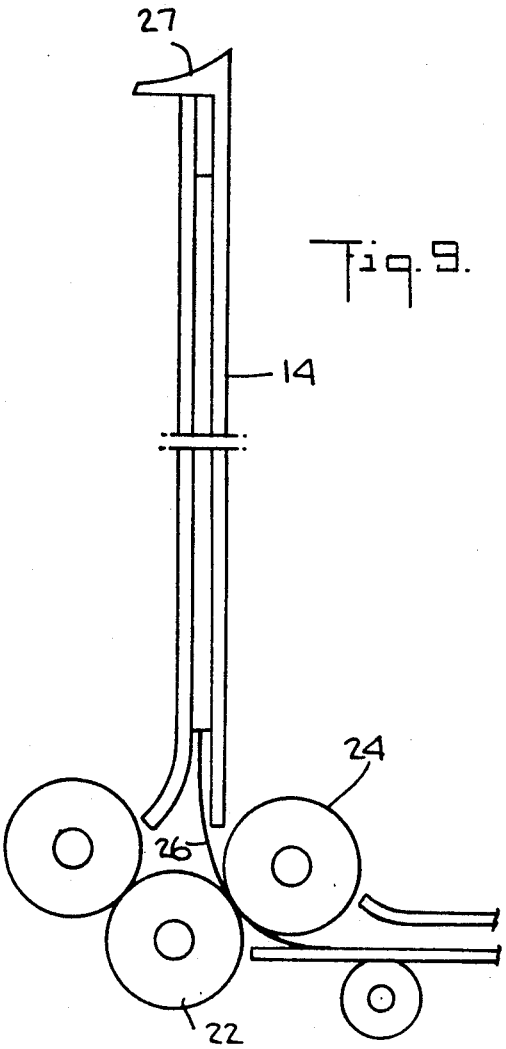
FIG. 9 is a side, elevational view showing a paper sheet leaving the inverter chute after having been inverted.
Figure 10:
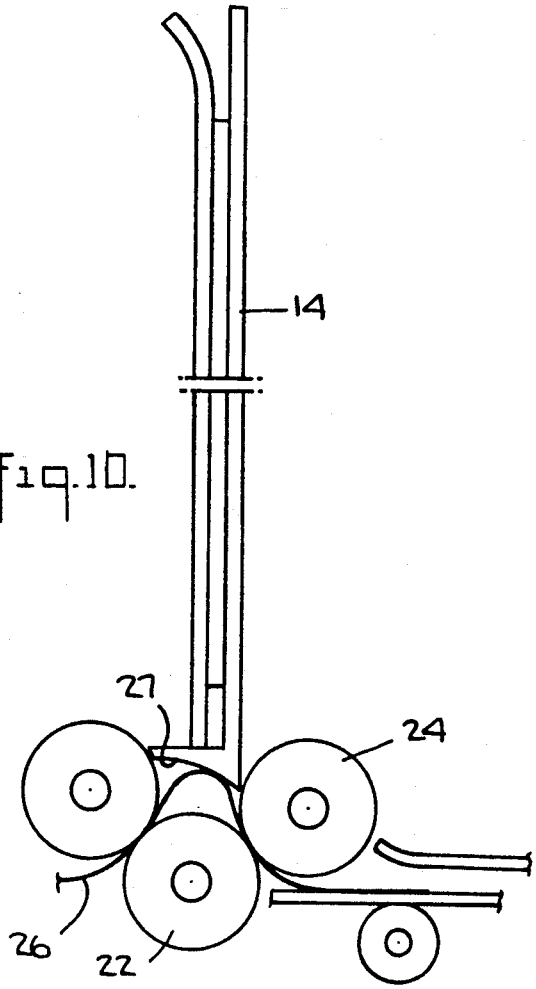
FIG. 10 is similar to FIG. 9 but shows the buckle chute inverted in its bypass mode so that the paper sheet does not enter the inverter chute.

In operation, paper sheets 26 are fed with the address face down from the document feeder 28 to the first buckle chute folder 10. If the address is positioned near the lead edge of the sheet 26 (left or right), the inverter chute 14 would be in the bypass mode, which is effected by placing the inverter chute 14 upside down as shown in FIG. 10. With the inverter chute 14 in the bypass mode, the sheet 26 avoids entering the inverter chute 14 and arrives on the transport module 46 with the address face up. The buckle chute folder 10, in the course of imparting a fold to the sheet 26, turns the lead half of the sheet 26 upside down, so that if the address is initially positioned face down, the sheet 26 emerges from the folder 10 with the address face up. The top, closed end of the inverting chute 14 includes a paper guide 27 (see FIG. 9), which when the chute 14 is reversed, as seen in FIG. 10, functions to guide the paper sheet 26 past the chute 14 toward the rollers 22 and 24.

In some applications it happens that the address is placed near the trailing edge of the sheet 26 (left or right). Since the buckle chute folder 10 does not turn the trailing portion of the sheet 26 over, as in the case above with the address adjacent the lead edge, the once folded sheet 26 must pass through the inverting chute 14 in order for the sheet 26 to enter the transport module 46 with the address face up.

The inversion of the once folded sheet 26 is effected by driving the once folded sheet 26 beyond the nip of the rollers 20 and 22. The speed and inertia of the once folded sheet 26 carries it to a spring loaded stop 70 (see FIG. 4), which is moved upward by the force of the driven sheet 26 (see FIG. 5). As seen in FIG. 6, the spring stop 70 ultimately returns to its original position. The return spring 70 and gravity force the sheet 26 out of the inverter chute 14 into the nip of the rollers 22 and 24. Thus, the sheet 26 has been turned over without an additional fold being imparted.

As seen in FIGS. 4–6, the inverter chute 14 tapers toward the top. The wider opening at the bottom of the chute 14 permits a greater number of sheets 26 to enter the chute 14 if so desired.

While the invention has been described in conjunction with specific embodiments thereof, many alternative, modifications and variations will be apparent to those skilled in the art. It is intended to embrace all such alternatives, modifications and variations that follow within the spirit and scope of the appended claims.

What is claimed is:

1. A apparatus for cross-folding a sheet of paper, comprising:

a first paper folder for imparting a first fold to a paper sheet;

an inverting chute located adjacent and downstream of said first paper folder, said inverting chute having an open end and a closed end;

a transport module located adjacent and downstream of said inverting chute for changing the direction of travel of said once folded paper sheet perpendicular to the direction of travel through said first paper folder;

a second paper folder for imparting a second fold to said once folded paper sheet perpendicular to said first fold; and a housing for supporting said inverting chute between a normal mode and a bypass mode;

wherein said inverting chute is rotated between said two modes, in the normal mode said inverting chute is situated with said open end allowing said once folded paper sheet to enter said inverting chute and in said bypass mode said closed end prevents said once folded paper sheet from entering said inverting chute.

2. The apparatus of claim 1, wherein the closed end of said inverting chute includes a paper guide for urging said once folded paper sheet to bypass said inverting chute when said inverting chute is in said bypass mode.

* * * * *